US008020323B2

(12) United States Patent
Chagnot et al.

(10) Patent No.: US 8,020,323 B2
(45) Date of Patent: Sep. 20, 2011

(54) DRILLING TOOL

(75) Inventors: Philippe Chagnot, Nanterre (FR); Fabrice Mathieu, Nanterre (FR); Daniel Perpezat, Nanterre (FR); Jean-Claude Riglet, Nanterre (FR)

(73) Assignee: Compagnie du Sol, Nanterre (FR)

( * ) Notice: Subject to any disclaimer, the term of this patent is extended or adjusted under 35 U.S.C. 154(b) by 111 days.

(21) Appl. No.: 12/295,851

(22) PCT Filed: Apr. 4, 2007

(86) PCT No.: PCT/FR2007/051062

§ 371 (c)(1),
(2), (4) Date: Dec. 1, 2008

(87) PCT Pub. No.: WO2007/116178

PCT Pub. Date: Oct. 18, 2007

(65) Prior Publication Data

US 2009/0165338 A1 Jul. 2, 2009

(30) Foreign Application Priority Data

Apr. 6, 2006 (FR) ..... 06 51240

(51) Int. Cl.
*E02F 3/24* (2006.01)

(52) U.S. Cl. ..... 37/189

(58) Field of Classification Search ..... 37/189, 37/352, 365, 91, 94, 364, 468; 299/75, 78, 299/106; 175/91, 96; 405/263, 266, 267
See application file for complete search history.

(56) References Cited

U.S. PATENT DOCUMENTS

| | | | | |
|---|---|---|---|---|
| 1,814,094 | A * | 7/1931 | Rhodes | 37/347 |
| 2,048,710 | A * | 7/1936 | Ranney | 405/267 |
| 3,894,587 | A * | 7/1975 | Sourice | 175/91 |
| 4,744,425 | A * | 5/1988 | Hentschel | 175/73 |
| 4,785,559 | A * | 11/1988 | Hentschel | 37/94 |
| 4,800,967 | A * | 1/1989 | Chagnot et al. | 175/96 |
| 4,883,134 | A * | 11/1989 | Bollinger et al. | 175/96 |
| 5,111,601 | A * | 5/1992 | Casagrande | 37/91 |
| 6,270,163 | B1 * | 8/2001 | Mullet et al. | 299/75 |
| 6,626,500 | B1 * | 9/2003 | Cribb et al. | 299/78 |
| 7,114,271 | B2 * | 10/2006 | Chagnot et al. | 37/352 |
| 7,178,273 | B2 * | 2/2007 | Arzberger | 37/189 |
| 7,363,733 | B2 * | 4/2008 | Stoetzer | 37/189 |
| 7,476,057 | B2 | 1/2009 | Arzberger et al. | |
| 7,497,038 | B2 * | 3/2009 | Arzberger | 37/189 |
| 7,604,301 | B1 * | 10/2009 | Lang | 299/75 |
| 7,707,752 | B2 * | 5/2010 | Stoetzer | 37/195 |
| 7,765,723 | B2 * | 8/2010 | Chagnot et al. | 37/94 |
| 2004/0234345 | A1 | 11/2004 | Arzberger | |

(Continued)

FOREIGN PATENT DOCUMENTS

DE 16 34 262 B 9/1970

(Continued)

*Primary Examiner* — Robert Pezzuto
(74) *Attorney, Agent, or Firm* — Kenyon & Kenyon LLP

(57) ABSTRACT

The invention relates to a drilling tool comprising: two pairs of rotary drums in axial alignment on parallel axes; a motor mechanism for driving rotation of the drums; a support element; and a support structure on which the drums are mounted to rotate and serving to connect the drums to the support element; the tool being characterized in that the motor mechanism is mounted inside the drums and in that the support structure comprises a plate forming bearings at its bottom ends for the drums; and a mounting pad for fastening to the support element.

14 Claims, 3 Drawing Sheets

U.S. PATENT DOCUMENTS

| | | | | |
|---|---|---|---|---|
| 2004/0256908 | A1* | 12/2004 | Risi | 299/78 |
| 2005/0000123 | A1 | 1/2005 | Arzberger | |
| 2005/0229440 | A1 | 10/2005 | Arzberger | |
| 2006/0037218 | A1* | 2/2006 | Stoetzer | 37/352 |

FOREIGN PATENT DOCUMENTS

| | | | |
|---|---|---|---|
| EP | 0 262 050 | A1 | 3/1988 |
| EP | 1 533 425 | A | 5/2005 |
| GB | 1 430 617 | A | 3/1976 |

* cited by examiner

DRILLING TOOL

This is a 371 national phase application of PCT/FR2007/051062 filed 4 Apr. 2007, claiming priority to French Patent Application No. FR 0651240 filed 6 Apr. 2006, the contents of which are incorporated herein by reference.

FIELD OF THE INVENTION

The present invention relates to a drilling tool, particularly but not exclusively for making walls in the soil as obtained by mixing the cut soil with an additional binder.

BACKGROUND OF THE INVENTION

Soil mixing techniques whereby drilled ground is mixed in situ with a hydraulic binder are nowadays commonly used for improving substructures. The tools used generally employ special equipment resembling augers that are caused to rotate about a vertical axis. Those machines enable rectangular wall elements to be made by juxtaposing a plurality of augers, thereby requiring high-power machines to be used whenever the trench needs to reach depths greater than 10 meters (m).

A new type of machine has been in existence for several years that makes it possible to make rectangular foundation elements out of soil cement, i.e. by mixing a hydraulic binder with the soil that has been dug so as to make a portion of a trench, while also mixing the mixture. This operation is referred in the present patent application by the term "digging a trench while mixing cuttings with another material".

Naturally, the mixture must be left in place in the trench that is being made so as to end up with a wall in the soil that results from the mixture of cut soil and hydraulic binder setting, which wall has its shape defined by the shape of the trench.

A machine of this type is described for example in patent applications US 2005/0000123 and US 2004/0234345.

That machine is constituted essentially by two pairs of cutters mounted on a support structure. Each pair of cutters is connected to a hydraulic motor. The motors are housed in a relatively bulky box located above the cutters.

When the motor is mounted in a bulky box, the drawback presented by the machine consists in the box in which the motors are housed presenting a relatively large apparent area. The presence of this box of large dimensions interferes considerably with raising the tool after it has performed the mixing, since the box needs to "barge through" the mixed material constituted by soil cuttings and hydraulic binder. In some circumstances, while the machine is being raised, the presence of this box can lead to the machine becoming blocked in the panel filled with the mixture constituted by the drilling cuttings and the hydraulic binder.

In the machine of that type, that is described in patent application US 2005/0229440, the two pairs of cutters are connected by a common transmission to a single motor that may be situated above the surface of the ground. The transmission is then complex and its efficiency mediocre.

Furthermore, since the two pairs of cutters are driven by the same motor, all of the cutters rotate at the same speed. Unfortunately, it can sometimes be advantageous to be able to give each pair of cutters a different speed of rotation, in particular to correct departures from the vertical while digging the trench. In addition, the power from the motor is shared between the two pairs of cutters providing operation is normal. However, if one pair of cutters becomes blocked, then all of the power from the motor must be absorbed by the other pair of cutters. That requires the system to be dimensioned mechanically so as to be able to accommodate this situation.

Excavator machines are also known for making trenches in the soil. Such machines are usually constituted by two pairs of rotary cutters mounted at the bottom end of a structure of large dimensions. The top end of the structure is secured to support means that are generally constituted by cables.

In horizontal section, the structure of the machine is generally rectangular in shape with dimensions substantially equal to the overall dimensions of the pairs of cutters. Thus, the dimensions of the right section of the structure are substantially equal to the dimensions of the horizontal section of the portion of trench that the machine can dig as it moves downwards.

Thus, the walls of the structure are substantially in contact with the walls of the portion of trench being dug, thereby ensuring that the machine is guided vertically in order to obtain a portion of trench that is likewise substantially vertical.

In addition, the soil cut by the cutters is removed via a suction tube having its inlet disposed between the walls of the cutters beneath the structure.

It is clear that such an excavator machine is totally incapable of mixing the cut soil with the hydraulic binder, so that the mixture is left in place in the portion of trench being dug in order to make the wall in the soil.

Documents EP 0 262 050 and GB 1 430 617 describe such a machine.

SUMMARY OF THE INVENTION

An object of the present invention is to provide a drilling tool of this type that avoids the two above-mentioned drawbacks.

To achieve this object, the invention provides a drilling tool that comprises:

- two pairs of rotary drums in axial alignment on parallel axes, each drum being fitted with a cutter;
- motor means for driving rotation of said drums;
- support means; and
- a support structure on which said drums are mounted to rotate and serving to connect said drums to the support means;

said tool being characterized in that:

said motor means are mounted inside the drums; and said support structure comprises:

- a plate that is substantially orthogonal to the axes of rotation of the drums, the bottom ends of said plate forming bearings for said drums, said plate having constant thickness that is very small relative to the length of the axes of rotation of a pair of cutters; and
- a mounting pad connected directly to the bottom end of said support means and fastened to the top end of the plate, the top edge face of the plate connecting said pad to the bearing-forming means having a special shape so that, in association with the small thickness of the plate, it is significantly easier to raise the tool when it is being used for digging a trench while mixing cuttings with another material.

It will be understood, that since the motors driving the cutters are disposed inside the cutters, the tool does not have a box containing the motor or bulky transmission systems. Furthermore, each motor can be controlled independently to give each pair of cutters a different speed of rotation. Since there is no box above the cutters of the tool, it can be understood that raising the tool through the mixture of drilling cuttings and hydraulic binder is made considerably easier.

This is made easier still by the particular shape of the support structure having only an edge that is in a position to oppose the drilling tool being raised, and this edge has dimensions that are small and a shape that is appropriate.

Preferably, the motors are hydraulic motors and the tool further includes sets of pipes for powering said motors, which pipes are constituted by holes in the thickness of the plate of the support structure. Thus, these power pipes are located entirely within the plate and cannot oppose the tool being raised after the trench has been dug and the drilling cuttings mixed with the hydraulic binder.

Also preferably, the top edge face of the plate of the support means is chamfered. This further facilitates raising the drilling tool through the mixture of drilling cuttings and hydraulic binder.

Also preferably, the support means comprise at least one guide portion having its bottom end secured directly to the pad of the support structure.

Also preferably, the dimensions of the pad, which extends horizontally, are substantially equal to those of the right section of the guide beam.

Thus, while the tool is being raised through the trench filled with the mixture of cuttings and hydraulic binder, the pad lies in line with the guide portion and therefore does not oppose this upward movement.

Also preferably, the thickness of the guide beam in the direction of the axes of rotation of the cutters is less that half the length of the axis of rotation of a pair of cutters, and the width of the section of the guide beam is less than one-third the overall size of the two pairs of cutters in the horizontal direction perpendicular to said axis of rotation.

BRIEF DESCRIPTION OF THE DRAWINGS

Other characteristics and advantages of the invention appear better on reading the following description of embodiments of the invention given by way of non-limiting example. The description refers to the accompanying figures, in which.

DETAILED DESCRIPTION

Figure 1:
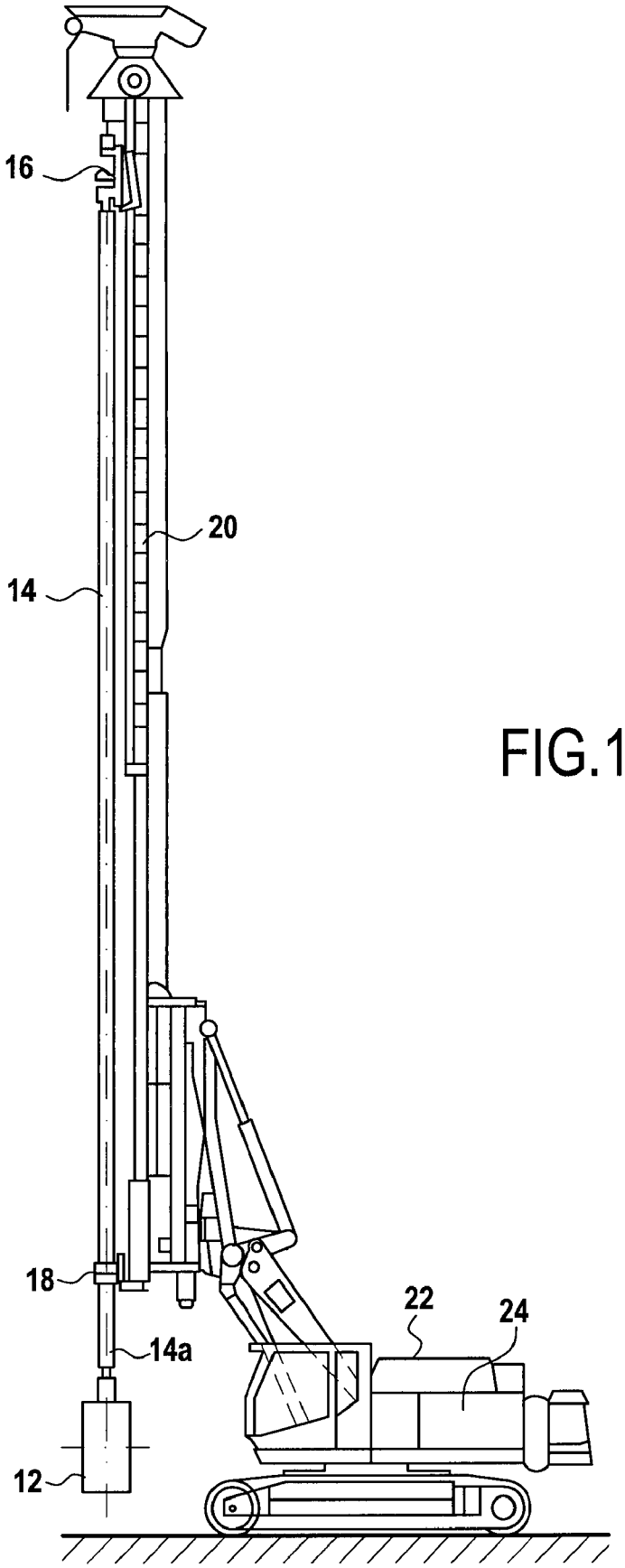
FIG. 1 is an elevation view of a drilling installation using the drilling tool of the invention.

FIG. 1 shows a drilling machine using the drilling tool in accordance with the invention. The tool 12 is guided in the trench by a guide beam 14 of constant profile and preferably of rectangular right section. The tool 12 is fastened to the bottom end 14*a* of the beam. The guide beam 14 serves to transmit thrust forces and traction forces to the tool 12. It also serves to protect the pipes feeding the tool with hydraulic binder, together with the pipes powering the motors that drive rotation of the cutters. The guide beam 14 is connected by guide and drive means 16, 18 to a vertical mast 20. The mast is supported by a tracked vehicle 22 having installed thereon a system 24 for generating hydraulic power.

It will be understood that by causing the guide beam 14 to move upwards and downwards, the tool 12 is caused to move vertically in the soil so as to make a panel of a trench by drilling the soil and mixing the drilling cuttings with the hydraulic binder.

Figure 2:
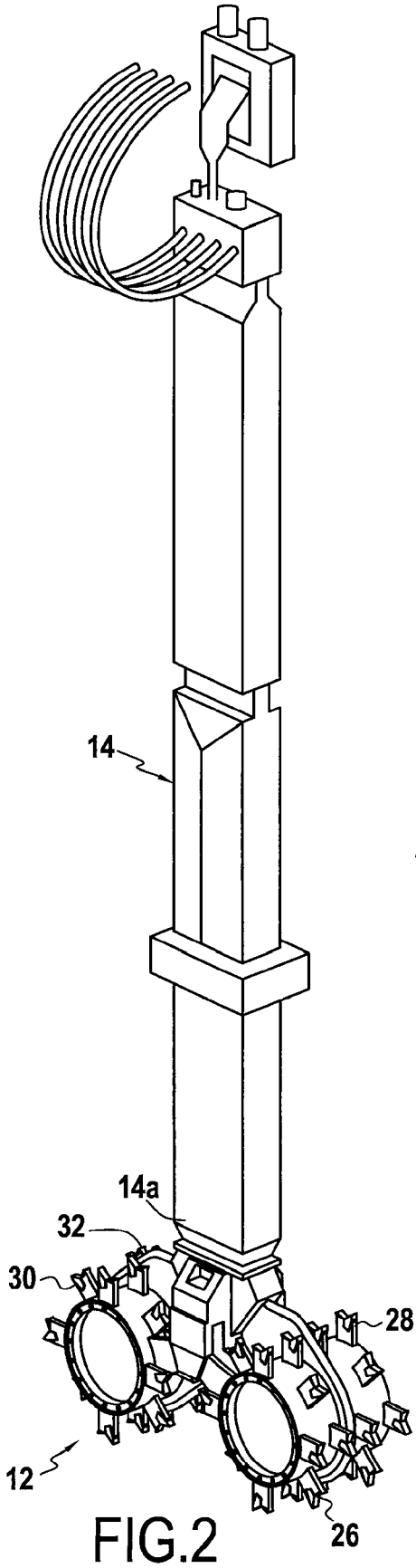
FIG. 2 is a perspective view of the drilling tool with its guide bar.
Figure 3:
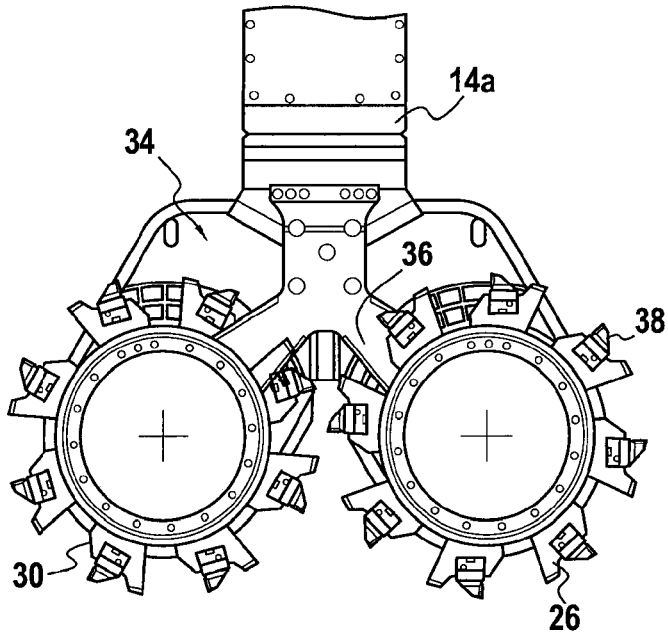
FIG. 3 is an elevation view of the drilling tool assembly.

FIG. 2 shows the guide beam 14 with the drilling tool proper 12 secured to its bottom end 14*a*. The drilling tool is constituted by two pairs of cutters 26 & 28 and 30 & 32, with the cutters in a given pair being on a common axis and with the axes of rotation of the cutters being parallel and substantially horizontal in use. As explained below, according to an essential characteristic of the invention, the motors for driving rotation of the cutters 26 to 32 are disposed inside the cutters themselves, thereby avoiding any need to provide an external motor for driving the cutters.

More precisely, the pairs of cutters 26 to 32 are connected to the bottom end 14*a* of the guide bar by a support structure given overall reference 34. In a variant, the support structure 34 may be fitted with scraper systems 36 that serve, when the soil is sticky, to remove the soil that adheres to the cutters between their teeth 38.

Figure 5:
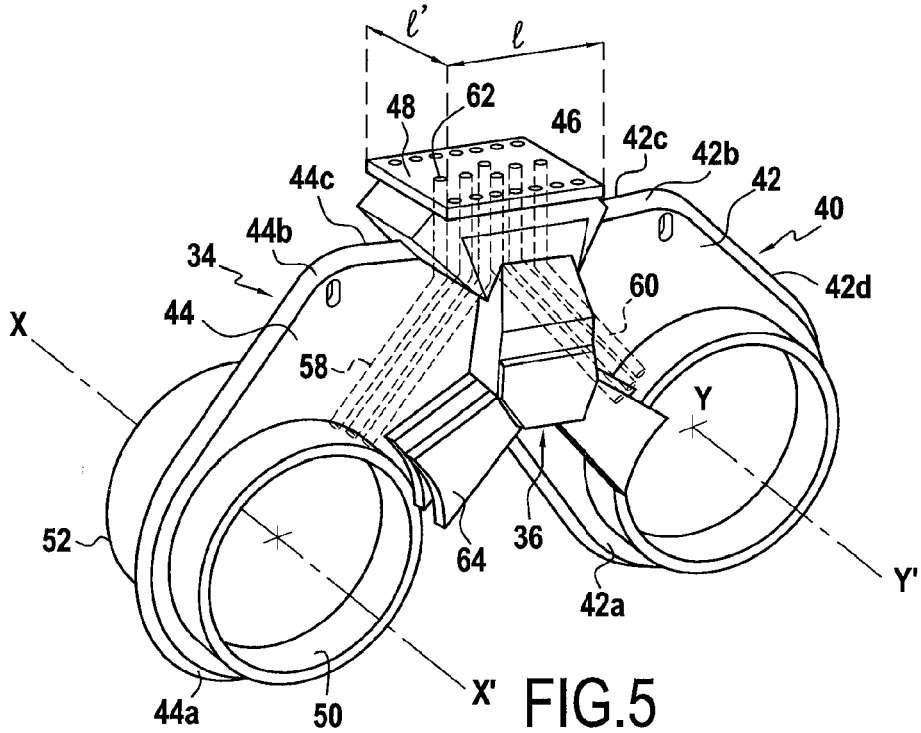
FIG. 5 is a perspective view of the support means for the cutters of the drilling tool.

With reference now to FIG. 5, there follows a description in greater detail of the support structure 34 of the tool. The support structure 34 is constituted firstly by a plate 40 that, in the particular embodiment described, consists of two half-plates 42 and 44 interconnected by a triangular part 46 connecting the two half-plates 42 and 44 to a mounting pad 48 used for securing the support structure 34 to the bottom end 14*a* of the guide beam. The pad 48 is naturally substantially horizontal and thus orthogonal relative to the half-plates 42 and 44. As shown in the figures, the mounting pad has substantially the same dimensions as the horizontal right-section of the guide portion 14. The bottom ends 44*a*, 42*a* of the half-plates are fitted on each of their faces with pairs of coaxial cylindrical bushings 50, 52 and 54, 56. These bushings have axes X, X' and Y, Y' that are orthogonal to the two half-plates 42 and 44 and that serve firstly for mounting the hydraulic motors and secondly for guiding rotation of the drum on which the cutters proper are mounted.

As is well known, the guide bar 48*a*, in horizontal right-section, is of dimensions that are very small compared with those of the drilling tool 12 and thus compared with those of the drilling performed by the tool.

Figure 4:
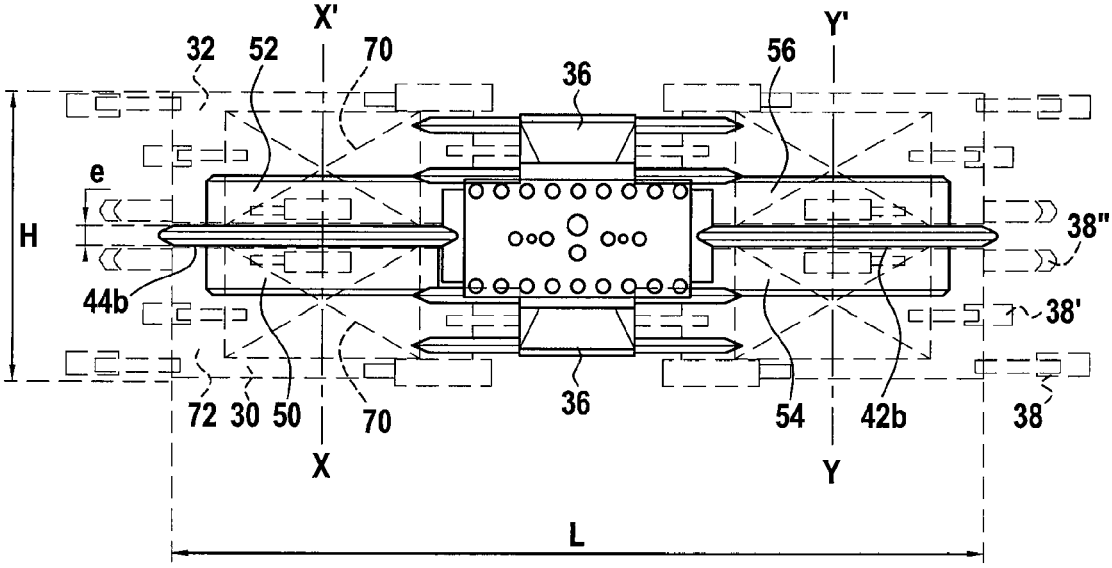
FIG. 4 is a partially phantom plan view of the drilling tool.

More precisely, the depth l' of the pad 48 (see FIG. 5) is less than half the length H of the axis of a pair of cutters 26 to 32 (see FIG. 4). The width l of the pad 48 (see FIG. 5) is less than one-third of the length L of the drilling tool 12 (see FIG. 4), where "length" designates its maximum dimension in a horizontal plane.

Preferably, the top edge face 44*b*, 42*b* of each half-plate presents a first portion 44*c*, 42*c* that is substantially horizontal and short in length followed by a downwardly-sloping portion 44*d*, 42*d*, thereby constituting the sides of a triangle of apex that would be disposed towards the pad 48. Also preferably, the edge faces 42*b*, 44*b* of the half-plates 42 and 44 are chamfered, as can be seen more clearly in FIG. 4.

More generally, the top edge face of the plate 40 is of a shape that makes it easier to raise the drilling tool through the mixture of cut soil and hydraulic binder that is contained in the trench.

As already mentioned, the motors for driving rotation of the cutters are preferably hydraulic motors. Under such circumstances, the power fluid feed pipes are constituted by holes such as 58 and 60 made in the thickness of the half-plates 42 and 44. The top ends of the pipes 58, 60 open out into orifices such as 62 that are formed in the pad 48 for connecting the pipes 58 and 60 to the power fluid feed pipes that are located in the guide bar 14.

Under some circumstances, when the soil is sticky, scraper systems 36 are fastened on either side of the central triangular part 46 of the support means 34. These scraper systems 36 comprise scrapers such as 64 that are interleaved between the rows of teeth 38, 38', 38" of the cutters so as to remove the soil that might adhere to the cutters between these teeth.

It should be observed that the scraper systems 36 present a profile that makes it easier to raise the drilling tool through the mixture of drilling cuttings and hydraulic binder.

FIG. 4 shows the cutters 30 to 36 mounted on the bushings 50 to 56. Firstly there can be seen the hydraulic motors such as 70, which motors are fastened within the bushings 50 to 56. The outlet shafts from the motors 70 are connected mechanically in rotation and in translation to drums such as 72 having the cutters 30 to 36 together with their teeth 38, 38', and 38" mounted thereon. The ends of the hydraulic fluid feed pipes 58 and 60 are connected by any suitable means to the system for feeding power to the hydraulic motors 70.

It will be understood that when it is desirable to raise a drilling tool that is in a trench that is filled with a mixture of drilling cuttings and hydraulic binder, the only portions of the tool that oppose this upward movement are those constituted by the support plate 40 and possibly by the scraper systems 36. The pad 48 is located in line with the guide bar 14 and therefore does not constitute an obstacle to raising the drilling tool.

The half-plates 42 and 44 are of small thickness and they have top edges 44*b*, 42*b* of profile that facilitates raising the tool, as explained above.

In a particular embodiment, the drilling tool presents a width H in the direction of the axes of rotation X, X' and Y, Y' that is equal to 800 millimeters (mm) and a length L in the direction orthogonal to these axes of 2800 mm.

If consideration is now given to the support plate 40, its long dimension is 2200 mm and its thickness e is equal to 60 mm. Furthermore, the fastener plate 48 is rectangular in shape with sides having dimensions of 600 mm and 300 mm. It will be understood that during upward movement, the fastener plate 48 does not constitute an obstacle to such movement since it is in line with the guide bar 14. Consequently, a length of only 1600 mm of the support plate 40 needs to be taken into consideration. Thus, the area opposing upward movement is 1600 mm×60 mm=96,000 square millimeters ($mm^2$). This section should be compared with the horizontal projection of the tool assembly, which projection presents an area equal to 2800 mm×800 mm, which is more than 2 million $mm^2$. The area opposing upward movement is thus less than 5% of the area of the tool. During upward movement, the cutters are caused to rotate and therefore do not oppose such movement. When a cutting tool is fitted with pairs of cutters having axes that present a width of 500 mm, this ratio is slightly less than 10%. In general, the ratio between the areas is preferably less than 10%.

More generally, and preferably, the thickness e of the support plate 40 is less than 15% of the width H of the tool in the direction of the axes of rotation X, X' and Y, Y'. More preferably, the ratio is no greater than 10%. This value for the ratio depends on the dimensions of the cutters. The larger the cutters, the smaller the ratio can be made. The means forming the plate 40 have a minimum thickness of 50 mm to 60 mm in order to ensure the plate presents sufficient strength and in order to make it possible to provide internal ducts therein for powering the motors.

The invention claimed is:

1. A tool for drilling and mixing cuttings with another material, the tool comprising:

two pairs of rotary drums in axial alignment on parallel axes, each drum being fitted with a cutter for drilling and mixing the cuttings with another material;

a motor mechanism for driving the rotation of said drums, said motor mechanisms being mounted inside the drums;

a support element comprising a guide beam having a thickness and a length in horizontal section which are substantially less than a thickness and length in horizontal section of the tool; and a support structure on which said drums are mounted to rotate and which are serving to connect said drums to the support element;

said support structure comprising:

a plate that is substantially orthogonal to the axes of rotation of the drums, the bottom ends of said plate forming bearings for said drums, said plate having a constant thickness which is substantially less than the length of the axes of rotation of a pair of cutters; and a mounting pad connected directly to the bottom end of said guide beam and fastened to the top end of the plate, the top edge face of the plate connecting said pad to the bearing-forming portion being shaped so that, in association with the thickness of the plate being less than the length of the axes of rotation of a pair of cutters, the tool can be raised through the mixture of cuttings and another material, wherein the width of said mounting pad is less than one-third the length of the drilling tool in the horizontal direction orthogonal to the direction of the axes of the pairs of cutters.

2. A tool according to claim 1, wherein said motor mechanism comprises hydraulic motors and the tool further includes sets of pipes for powering said motors, which pipes are constituted by holes formed in the thickness of said plate.

3. A tool according to claim 1, wherein the horizontal right section of the guide beam has substantially the same dimensions as said mounting pad.

4. A tool according to claim 1 wherein the depth l' of said mounting pad in the direction of the axes of the pairs of cutters is less than half the length of an axis of a pair of cutters.

5. A tool according to claim 1, wherein the top edge of said plate is chamfered.

6. A tool according to claim 1, wherein the thickness of the plate is less than 15% of the length of the axis of rotation of a pair of cutters.

7. A tool according to claim 1, wherein the top edge face of said plate connecting the bottom ends of the plate to said mounting pad includes portions forming two sides of a triangle having its apex located towards said pad.

8. A tool according to claim 1, wherein, in projection onto a plane parallel to the axes of rotation of the cutters, the area of said plate is no greater than 10% of the area of the pairs of cutters.

9. A tool according to claim 1, wherein the thickness of the plate is less than 10% of the length of the axis of rotation of a pair of cutters.

10. A tool according to claim 1, wherein the plate consists of two half-plates.

11. A tool according to claim 10, wherein each half-plate is fitted with a pair of coaxial cylindrical bushings whose axes are orthogonal to the two half-plates.

12. A tool according to claim 10, wherein the two half-plates are connected to the mounting pad by a part.

13. A tool according to claim 1, wherein the mounting pad is located in line with the guide beam.

14. A drilling machine comprising a tool according to claim 1 and further comprising guide and drive means by which the guide beam is connected to a vertical mast, said mast being supported by a tracked vehicle having installed thereon a system for generating hydraulic power.

* * * * *